US010421008B2

(12) United States Patent
Gantumur et al.

(10) Patent No.: US 10,421,008 B2
(45) Date of Patent: Sep. 24, 2019

(54) PUZZLE AND ASSOCIATED USE THEREOF

(71) Applicants: Bayarsaikhan Gantumur, Rosemont, IL (US); Gankhulug Bayarsaikhan, Vienna (AT)

(72) Inventors: Bayarsaikhan Gantumur, Rosemont, IL (US); Gankhulug Bayarsaikhan, Vienna (AT)

( * ) Notice: Subject to any disclaimer, the term of this patent is extended or adjusted under 35 U.S.C. 154(b) by 0 days.

(21) Appl. No.: 15/863,657

(22) Filed: Jan. 5, 2018

(65) Prior Publication Data

US 2018/0185745 A1 Jul. 5, 2018

Related U.S. Application Data

(60) Provisional application No. 62/442,881, filed on Jan. 5, 2017.

(51) Int. Cl.
*A63F 9/12* (2006.01)

(52) U.S. Cl.
CPC .... *A63F 9/1288* (2013.01); *A63F 2009/1236* (2013.01); *A63F 2009/1292* (2013.01); *A63F 2009/1296* (2013.01); *A63F 2250/505* (2013.01)

(58) Field of Classification Search
CPC ..... A63F 9/1288; A63F 2009/1292; A63F 2009/1236; A63F 2009/1244
See application file for complete search history.

(56) References Cited

U.S. PATENT DOCUMENTS 416,344 A * 12/1889 Rice ..... A63F 9/0826 273/153 S
1,471,943 A * 10/1923 Chambers ..... A63F 9/12 273/157 R
2,839,841 A * 6/1958 Berry ..... A63H 33/04 273/157 R
3,565,442 A * 2/1971 Klein ..... A63F 9/12 273/157 R
3,645,535 A * 2/1972 Randolph ..... A63F 9/12 273/157 R
3,659,360 A * 5/1972 Zeischegg ..... G09B 23/04 273/155
3,785,651 A * 1/1974 Smith ..... A63F 9/0078 273/113
3,964,750 A * 6/1976 Brown ..... A63F 9/10 273/157 R
4,210,333 A * 7/1980 Shanin ..... A63F 9/1204 273/157 R (Continued)

FOREIGN PATENT DOCUMENTS

MN 2297 B1 4/2013

*Primary Examiner* — Steven B Wong
(74) *Attorney, Agent, or Firm* — Ashkan Najafi

(57) ABSTRACT

A puzzle includes a cube-shaped box having a cavity therein, a plurality of rhombus-shaped members detachably engaged to each other, and a plurality of pyramid-shaped members detachably engaged to the rhombus-shaped members. The rhombus-shaped members are intercalated between the pyramid-shaped members such that a combination of the rhombus-shaped members and the pyramid-shaped members collectively have a cube-shaped arrangement removably fitted inside the cavity of the cube-shaped box. At least two of the pyramid-shaped members are situated at a topmost region of the cavity of the cube-shaped box.

7 Claims, 17 Drawing Sheets

(56) References Cited

U.S. PATENT DOCUMENTS

| | | | | | |
|---|---|---|---|---|---|
| 4,258,479 | A * | 3/1981 | Roane | A63H 33/046 | 434/211 |
| 5,108,100 | A * | 4/1992 | Essebaggers | A63F 9/12 | 273/153 R |
| 5,660,387 | A * | 8/1997 | Stokes | A63F 9/12 | 273/157 R |
| 6,257,574 | B1 * | 7/2001 | Evans | A63F 9/12 | 273/157 R |
| 6,264,199 | B1 * | 7/2001 | Schaedel | A63F 9/088 | 273/155 |
| 7,140,612 | B2 * | 11/2006 | Chen | A63F 9/12 | 273/156 |
| 7,338,045 | B2 * | 3/2008 | Guha | A63F 7/042 | 273/109 |
| 7,389,908 | B2 * | 6/2008 | Cohen | B65D 5/008 | 206/459.5 |
| 8,727,351 | B2 * | 5/2014 | Agamawi | A63F 9/0869 | 273/155 |
| 2009/0014954 | A1 * | 1/2009 | Cook | A63F 9/1204 | 273/157 R |
| 2009/0289415 | A1 * | 11/2009 | McCarty | A63F 9/12 | 273/153 S |
| 2010/0264584 | A1 * | 10/2010 | Maddock | A63F 9/06 | 273/156 |

* cited by examiner

PUZZLE AND ASSOCIATED USE THEREOF

CROSS REFERENCE TO RELATED APPLICATIONS

This is a non-provisional patent application that claims the benefit of U.S. provisional patent application No. 62/442,881 filed Jan. 5, 2017, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to puzzles and, more particularly, to a puzzle including an attractive and unique packaging concept where tasty snacks, like chocolates or nuts, can be packaged into four, diamond-like geometric puzzle pieces which fit together in a unique manner to form a large three-sided pyramid, which collectively fits into a cubic-shaped box. Entertaining consumers of all ages, the puzzle would provide a tasty snack within a fun and challenging puzzle. The puzzle could also be produced as a puzzle alone, without the treats therein.

Prior Art

At least one of the present applicants is listed as the inventor of Mongolian Patent No. 2297, having a priority date of Oct. 15, 2006, Application No. 2863, issued Apr. 5, 2013, and titled "Magic Pyramid," which is incorporated by reference herein. The aforementioned subject matter discloses several geometric shapes (e.g., rhombus-shaped prisms) that are arranged in a desired pattern to create a predetermined shape (e.g., pyramid). Such geometric shapes are identified as "prior art" in the attached figures. Each geometric shape is configured from a flat sheet of material that includes markings, lines of weakness and/or perforations identifying where to fold the flat sheet and form the three-dimensional geometric rhombus-shaped prism.

However, a need remains for a puzzle in order to group such geometric shapes within an outer shell or housing for presentation and packaging. The exemplary embodiment(s) satisfy such a need by providing a puzzle including an attractive and unique packaging concept that is convenient and easy to use, lightweight yet durable in design, versatile in its applications, and designed for holding tasty snacks, like chocolates or nuts, that are packaged into four, diamond-like geometric puzzle pieces which fit together in a unique manner to form a large three-sided pyramid, which collectively fits into a cubic-shaped box.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a puzzle including an attractive and unique packaging concept where tasty snacks, like chocolates or nuts, can be packaged into four, diamond-like geometric puzzle pieces which fit together in a unique manner to form a large three-sided pyramid, which collectively fits into a cubic-shaped box. These and other objects, features, and advantages of the non-limiting exemplary embodiment(s) are provided by a puzzle including a cube-shaped box having a cavity therein, a plurality of rhombus-shaped members detachably engaged to each other, and a plurality of pyramid-shaped members detachably engaged to the rhombus-shaped members. Advantageously, the rhombus-shaped members are intercalated between the pyramid-shaped members such that a combination of the rhombus-shaped members and the pyramid-shaped members collectively have a cube-shaped arrangement removably fitted inside the cavity of the cube-shaped box. Notably, at least two of the pyramid-shaped members are situated at a top-most region of the cavity of the cube-shaped box.

In a non-limiting exemplary embodiment, each of the rhombus-shaped members includes a single and unitary first body having a first two-dimensional initial shape and a first three-dimensional final shape. Advantageously, the single and unitary first body further has a plurality of first lines of weakness, a plurality of first faces situated contiguously with the first lines of weakness, respectively, a plurality of first slots formed along selected ones of the first lines of weakness, and a plurality of first tabs adjustably attached to selected ones of the first faces, respectively. Notably, selected ones of the first tabs are removably inserted into selected ones of the first slots, respectively. In this manner, the single and unitary first body is at an unfolded first configuration when disposed at the first two-dimensional initial shape, and the single and unitary first body is at a folded first configuration when disposed at the first three-dimensional final shape.

In a non-limiting exemplary embodiment, each of the pyramid-shaped members includes a single and unitary second body having a second two-dimensional initial shape and a second three-dimensional final shape. Advantageously, the single and unitary second body further has a plurality of second lines of weakness, a plurality of second faces situated contiguously with the second lines of weakness, respectively, a plurality of second slots formed along selected ones of the second lines of weakness, and a plurality of second tabs adjustably attached to selected ones of the second faces, respectively. Notably, selected ones of the second tabs are removably inserted into selected ones of the second slots, respectively. In this manner, the single and unitary second body is at an unfolded second configuration when disposed at the second two-dimensional initial shape, and the single and unitary second body is at a folded second configuration when disposed at the second three-dimensional final shape.

In a non-limiting exemplary embodiment, a plurality of candies are removably disposed within the rhombus-shaped members and the pyramid-shaped members.

In a non-limiting exemplary embodiment, a pyramid-shaped auxiliary member is disposed exterior of the box. Such an auxiliary pyramid-shaped member has a plurality of coextensively shaped sides dimensioned larger than the cavity of the cube-shaped box.

In a non-limiting exemplary embodiment, each of the rhombus-shaped members are coextensively shaped.

In a non-limiting exemplary embodiment, each of the pyramid-shaped members are coextensively shaped.

The present disclosure further includes a method of utilizing a puzzle including the steps of: providing a cube-shaped box having a cavity therein; providing and detachably engaging a plurality of rhombus-shaped members to each other; providing and detachably engaging a plurality of pyramid-shaped members to the rhombus-shaped members; intercalating the rhombus-shaped members between the pyramid-shaped members; situating at least two of the pyramid-shaped members at a top-most region of the cavity of the cube-shaped box; and the rhombus-shaped members and the pyramid-shaped members collectively creating a cube-shaped arrangement removably fitted inside the cavity of the cube-shaped box.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
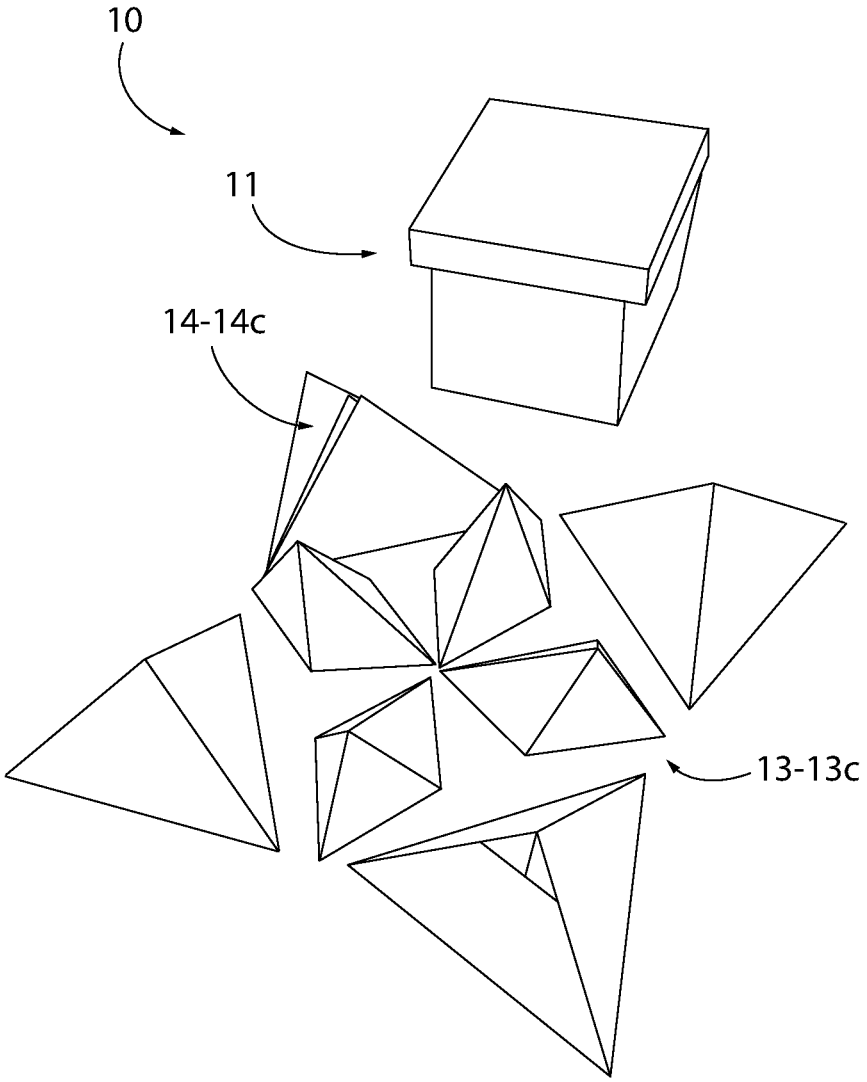
FIG. 1 is a perspective view of a puzzle wherein the rhombus-shaped members and pyramid-shaped members are disengaged and disposed exterior of the cube-shaped box, in accordance with a non-limiting exemplary embodiment of the present disclosure.
Figure 2:
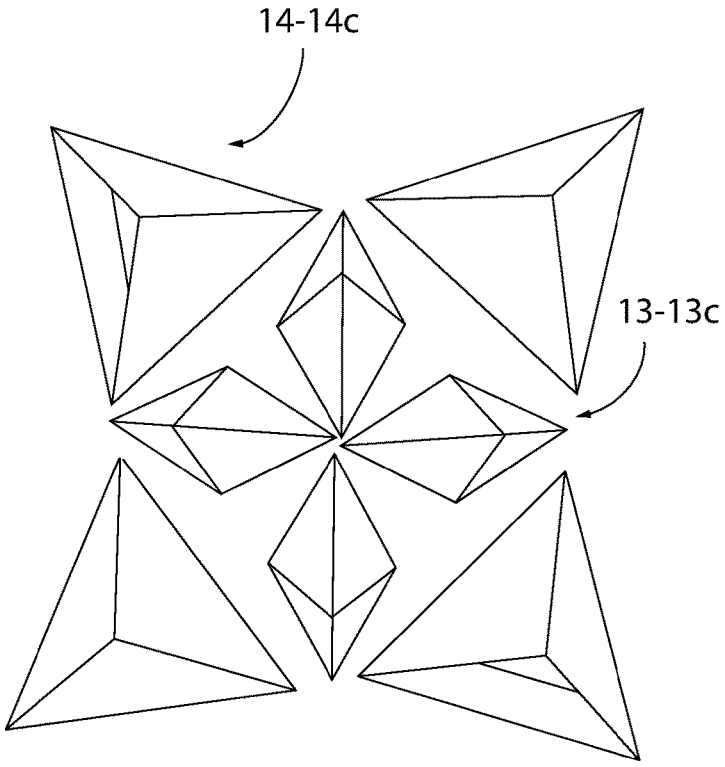
FIG. 2 is a top plan view of the rhombus-shaped members and pyramid-shaped members shown in FIG. 1.
Figure 3:
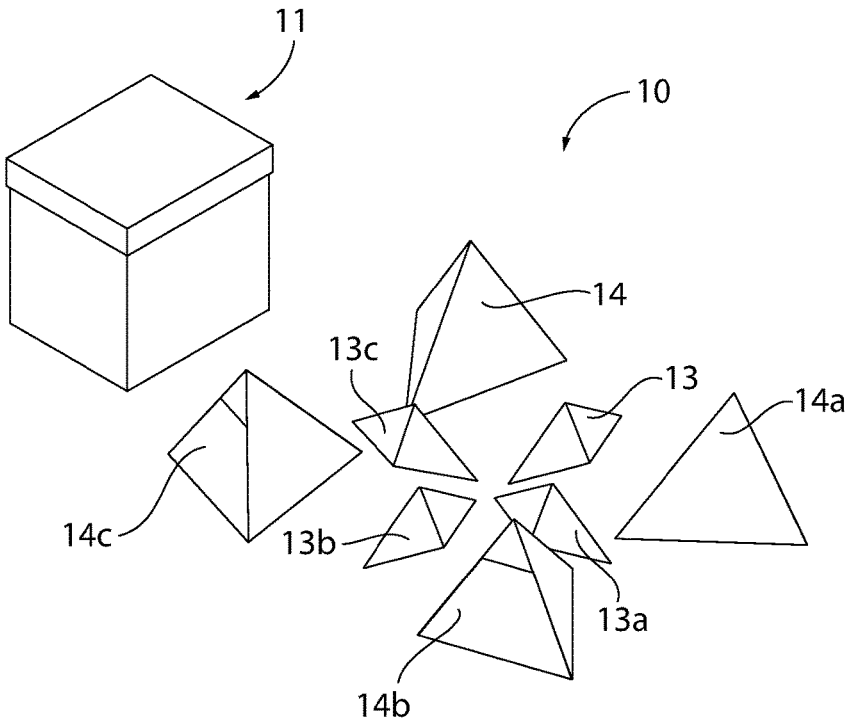
FIG. 3 is another perspective view of a puzzle wherein the rhombus-shaped members and pyramid-shaped members are disengaged and disposed exterior of the cube-shaped box.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

A non-limiting exemplary embodiment(s) of the present disclosure are referred to generally in FIGS. 1-18 and are intended to provide a puzzle 10 including an attractive and unique packaging concept where tasty snacks, like chocolates or nuts, can be packaged into geometric puzzle pieces which fit together in a unique manner to form a cube-shaped pattern, which collectively fits into a cubic-shaped box. It should be understood that the exemplary embodiment(s) may be used to contain a variety of edible items, and should not be limited to any particular edible item described herein.

The non-limiting exemplary embodiment(s) are referred to generally in FIGS. 1-18 and are intended to provide a puzzle 10 including a cube-shaped box 11 having a cavity 12 therein, a plurality of rhombus-shaped members 13-13*c* detachably engaged to each other, and a plurality of pyramid-shaped members 14-14*c* detachably engaged to the rhombus-shaped members 13-13*c*. Advantageously, the rhombus-shaped members 13-13*c* are intercalated between the pyramid-shaped members 14-14*c* such that a combination of the rhombus-shaped members 13-13*c* and the pyramid-shaped members 14-14*c* collectively form (have) a cube-shaped arrangement 15 removably fitted inside the cavity 12 of the cube-shaped box 11. Notably, at least two of the pyramid-shaped members 14*b*-14*c* are situated at a top-most region of the cavity 12 of the cube-shaped box 11. The cube-shaped box 11 is opaque such that a line of sight is blocked from an exterior of the cavity 12 to an interior of the cavity 12.

Figure 5:
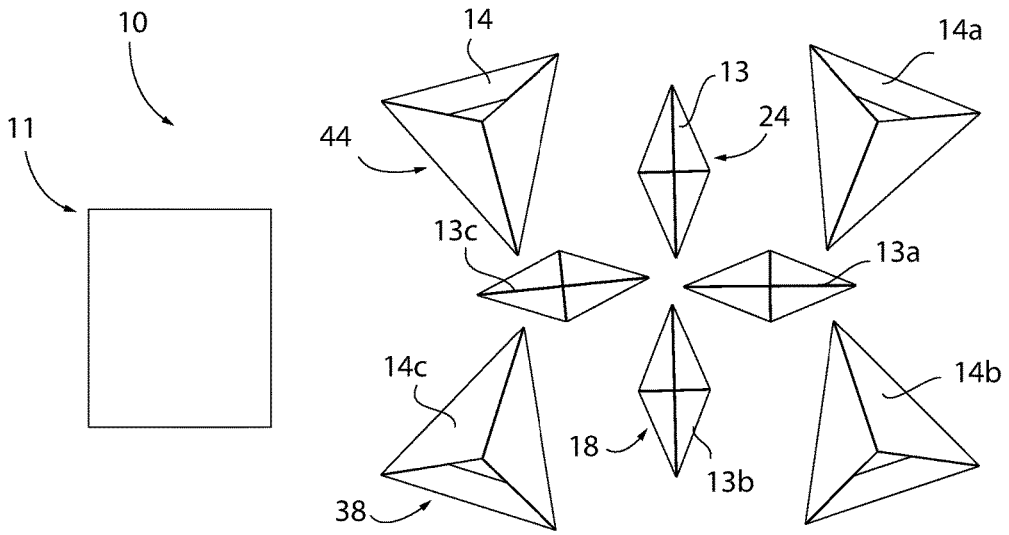
FIG. 5 is a top plan view of the puzzle shown in FIG. 3.
Figure 6:
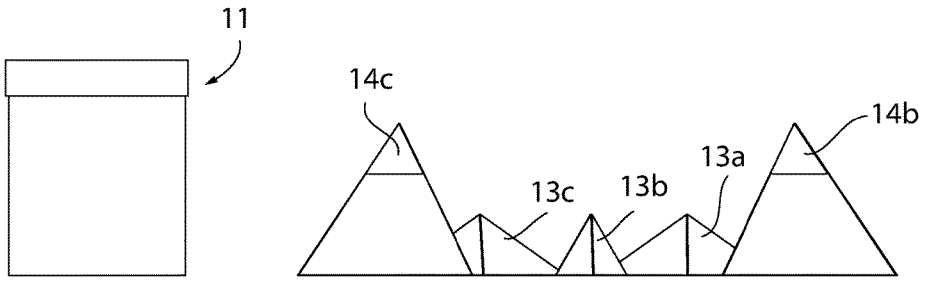
FIG. 6 is a side elevational view of the puzzle shown in FIG. 3.
Figure 9:
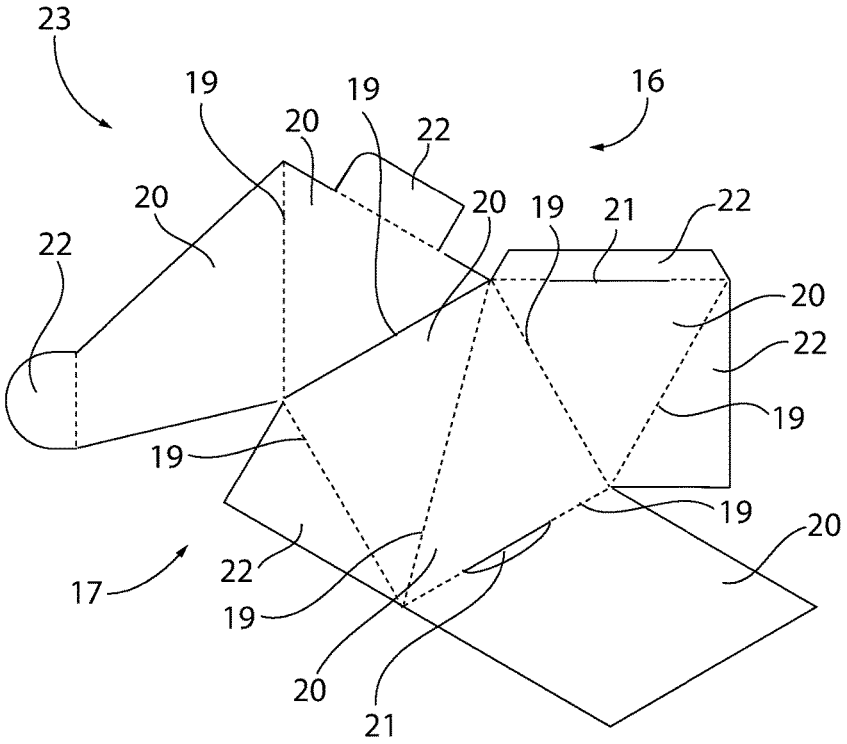
FIG. 9 is a top plan view of a two-dimensional unfolded second body of a rhombus-shaped member.
Figure 10:
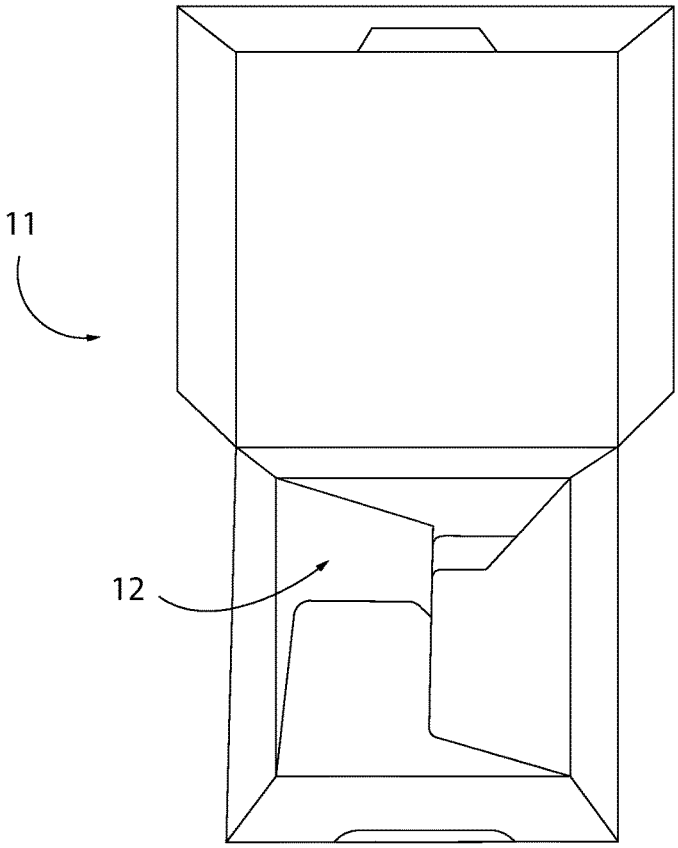
FIG. 10 is a top plan view of the cube-shaped box, with an open lid, shown in FIG. 1.
Figure 11:
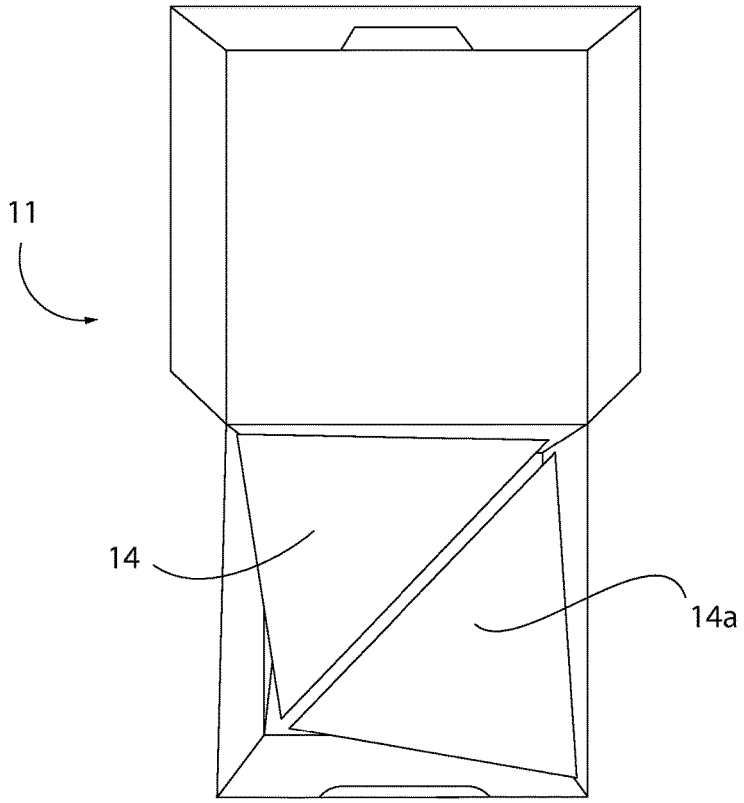
FIG. 11 is a top plan view showing a first step of initially positioning two of the pyramid-shaped members inside the cube-shaped box.
Figure 12:
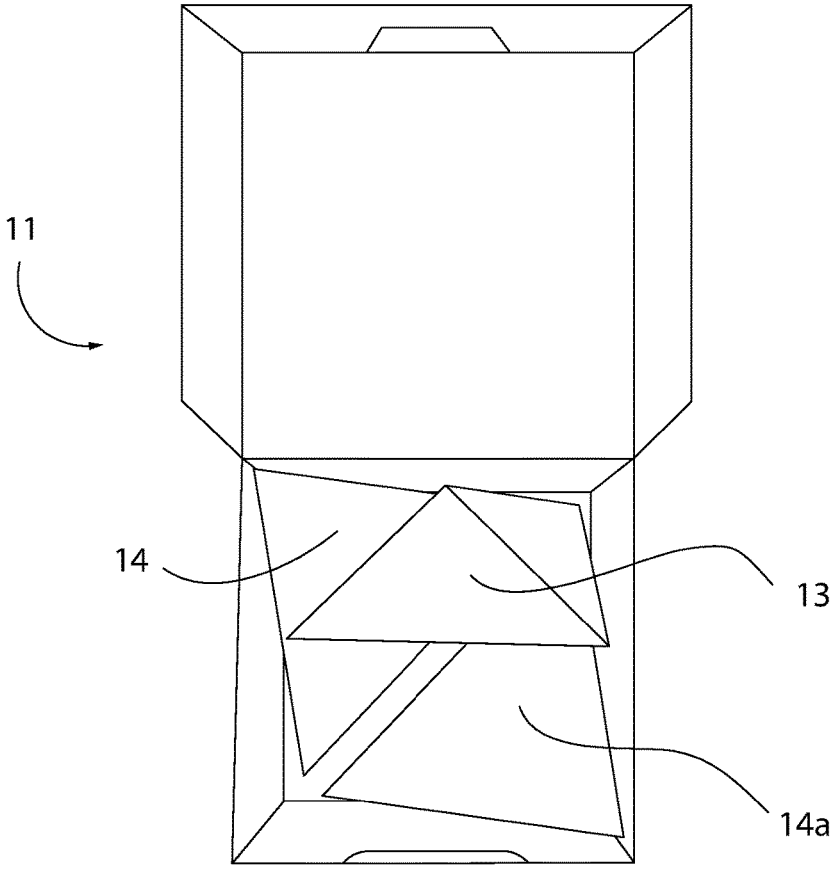
FIG. 12 is a top plan view showing a second step of positioning a first rhombus-shaped member in the cube-shaped box.
Figure 13:
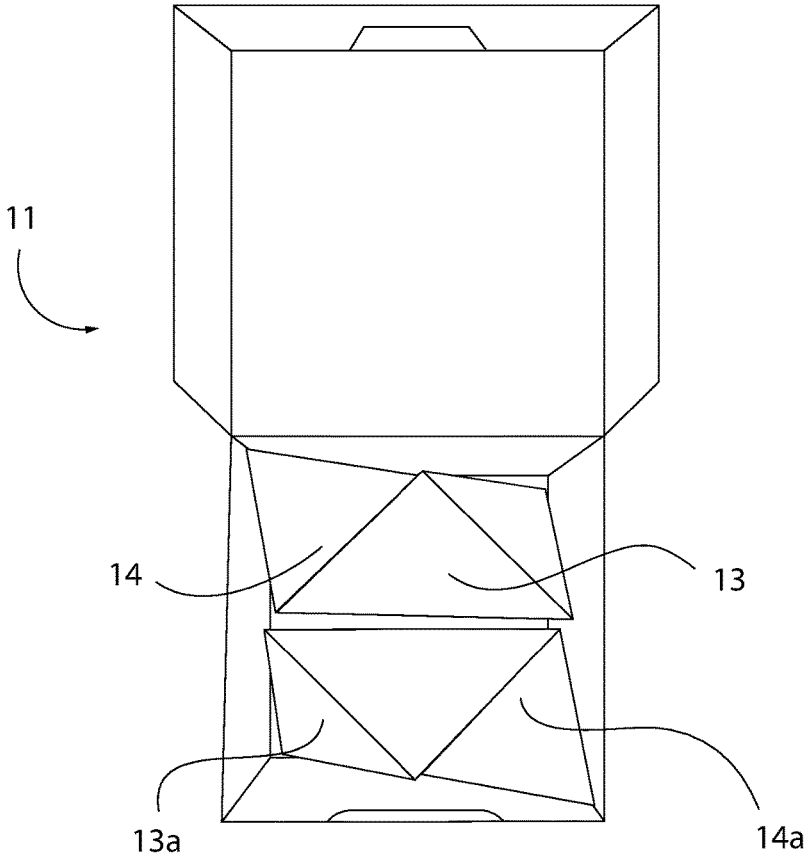
FIG. 13 is a top plan view showing a third step of positioning second and third rhombus-shaped members in the cube-shaped box.
Figure 14:
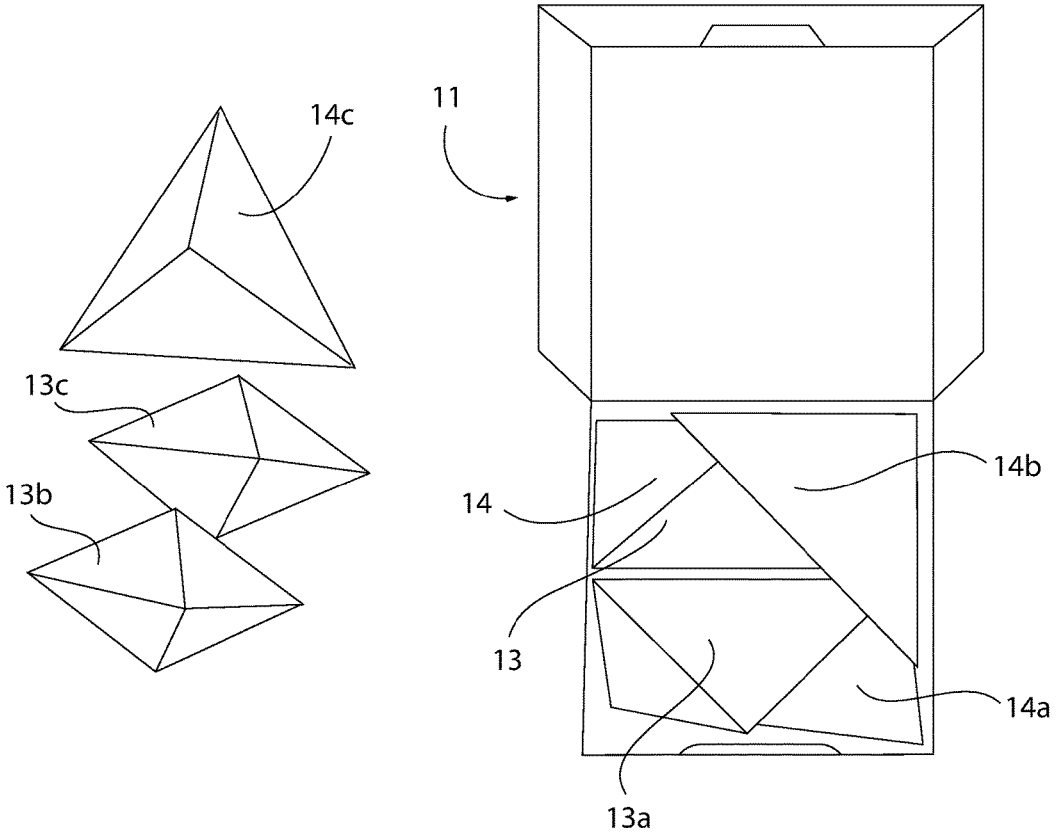
FIG. 14 is a top plan view showing a fourth step of positioning a third pyramid-shaped member in the cube-shaped box.
Figure 15:
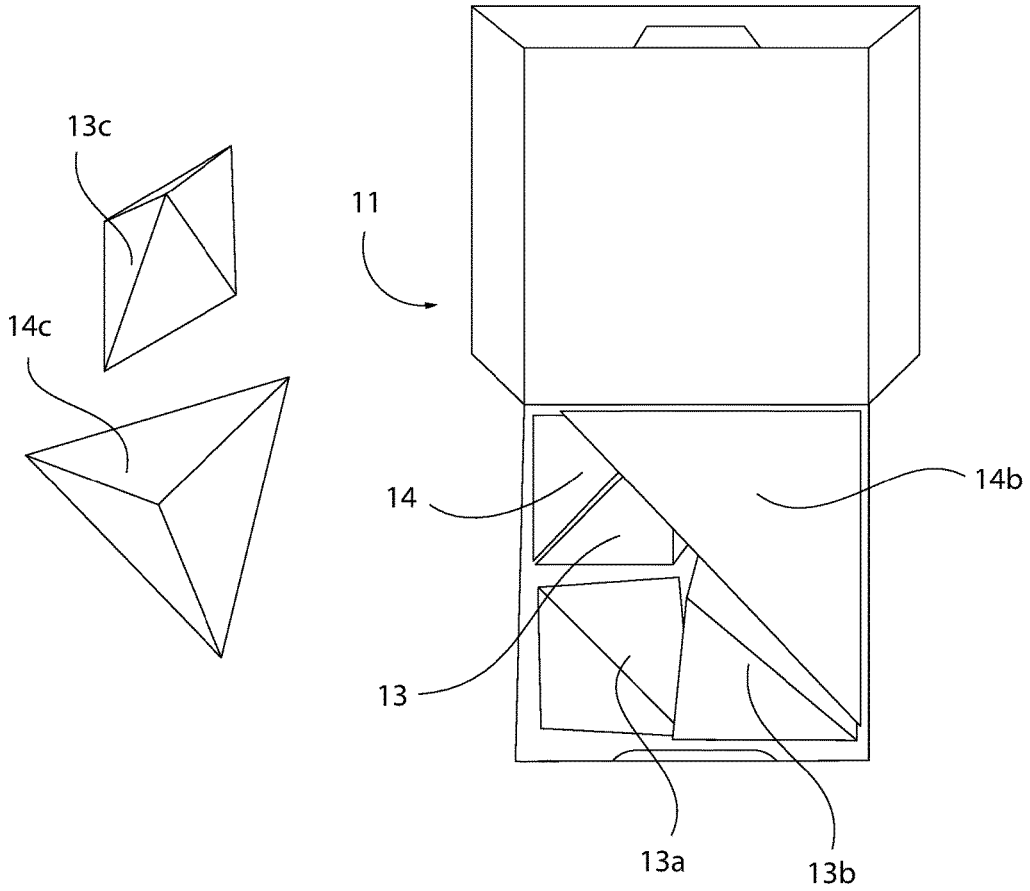
FIG. 15 is a top plan view showing a fifth step of positioning a third rhombus-shaped member in the cube-shaped box.
Figure 16:
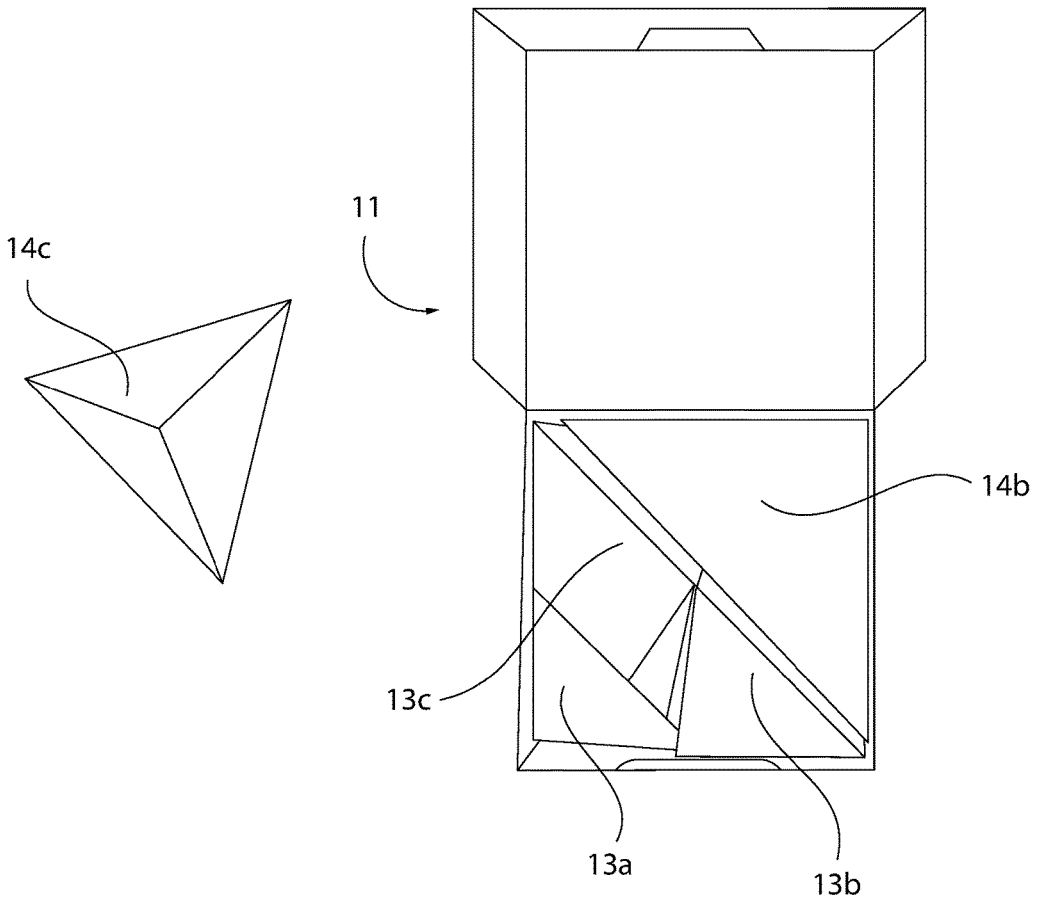
FIG. 16 is a top plan view showing a sixth step of positioning a fourth rhombus-shaped member in the cube-shaped box.
Figure 17:
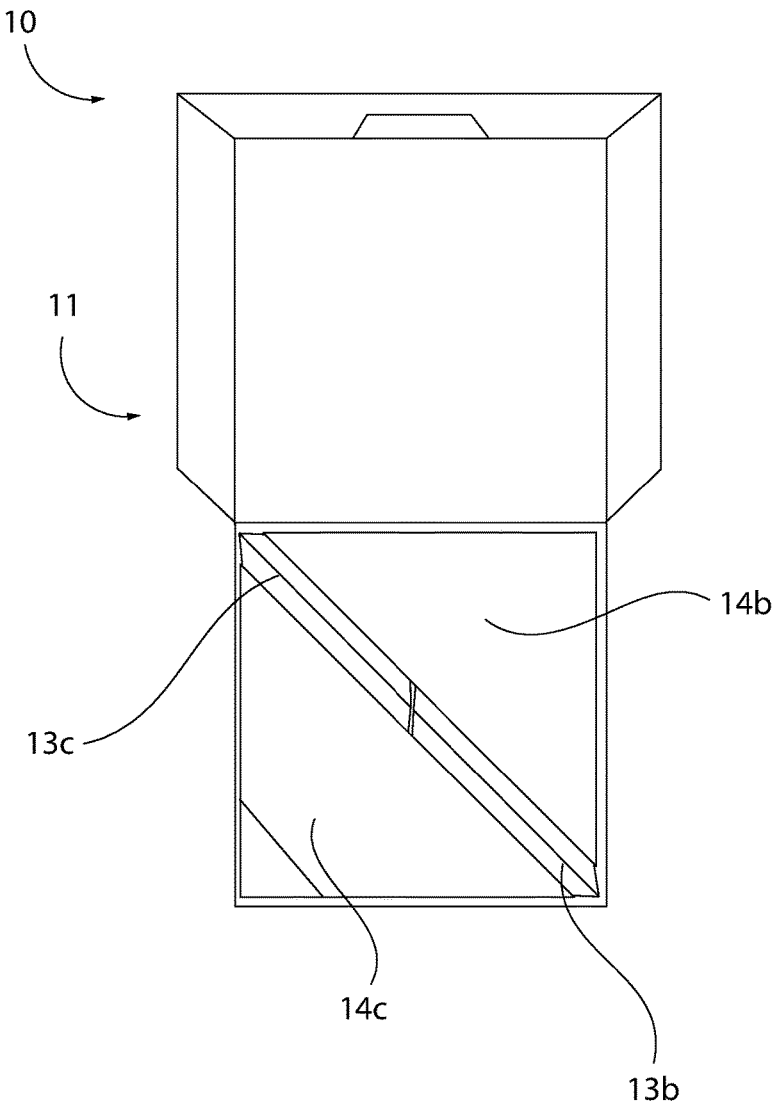
FIG. 17 is a top plan view showing a seventh step of positioning a fourth pyramid-shaped member in the cube-shaped box.

In a non-limiting exemplary embodiment, as perhaps best shown in FIGS. 5 and 9, each of the rhombus-shaped members 13-13*c* includes a single and unitary first body 16 having a first two-dimensional initial shape 17 and a first three-dimensional final shape 18. Advantageously, the single and unitary first body 16 further has a plurality of first lines of weakness 19, a plurality of first faces 20 situated contiguously with the first lines of weakness 19, respectively, a plurality of first slots 21 formed along selected ones of the first lines of weakness 19, and a plurality of first tabs 22 adjustably attached to selected ones of the first faces 20, respectively. Notably, selected ones of the first tabs 22 are removably inserted into selected ones of the first slots 21, respectively. In this manner, the single and unitary first body 16 is at an unfolded first configuration 23 when disposed at the first two-dimensional initial shape 17, and the single and unitary first body 16 is at a folded first configuration 24 when disposed at the first three-dimensional final shape 18.

Figure 8:
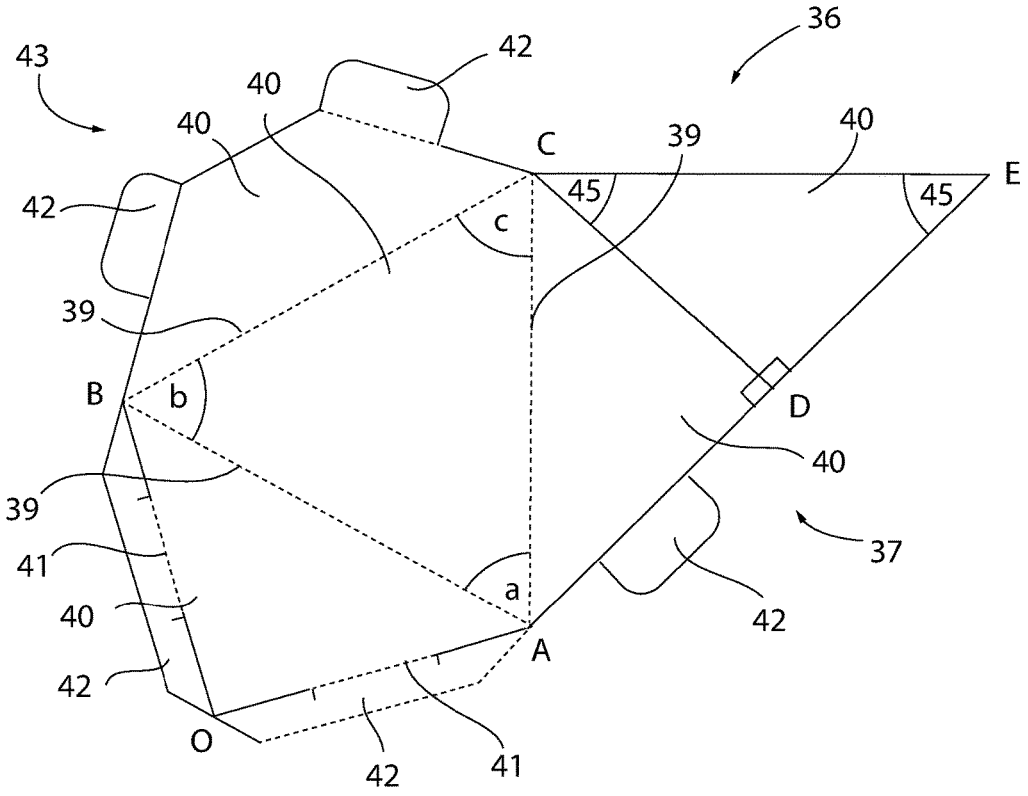
FIG. 8 is a top plan view of a two-dimensional unfolded first body of a pyramid-shaped member.

In a non-limiting exemplary embodiment, as perhaps best shown in FIGS. 5 and 8, each of the pyramid-shaped members 14-14*c* includes a single and unitary second body 36 having a second two-dimensional initial shape 37 and a second three-dimensional final shape 38. Advantageously, the single and unitary second body 36 further has a plurality of second lines of weakness 39, a plurality of second faces 40 situated contiguously with the second lines of weakness 39, respectively, a plurality of second slots 41 formed along selected ones of the second lines of weakness 39, and a plurality of second tabs 42 adjustably attached to selected ones of the second faces 40, respectively. Notably, selected ones of the second tabs 42 are removably inserted into selected ones of the second slots 41, respectively. In this manner, the single and unitary second body 36 is at an unfolded second configuration 43 when disposed at the second two-dimensional initial shape 37, and the single and unitary second body 36 is at a folded second configuration 44 when disposed at the second three-dimensional final shape 38.

Referring to FIG. 8, in a non-limiting exemplary embodiment, the pyramid-shaped members 14-14*c* have second body 36 including segments AB=BC=CA=90 millimeters. Segment CE=120 millimeters. Segments AD=DC=AO=OB=60 millimeters. The angle at "e" is 45 degrees. Angles "a," "b," and "c" ae 60 degrees.

Figure 4:
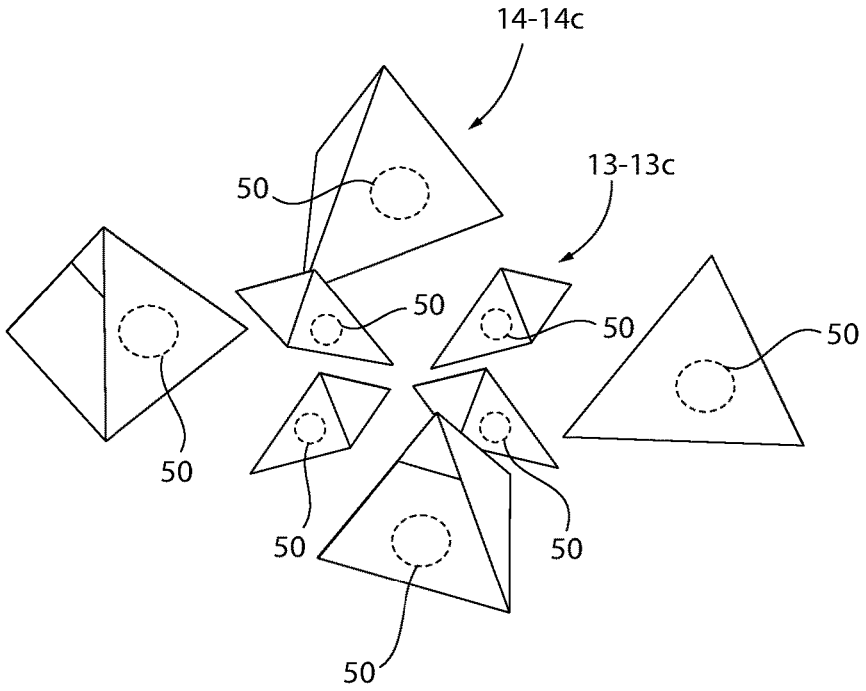
FIG. 4 is a perspective view of the rhombus-shaped members and pyramid-shaped members shown in FIG. 3.

In a non-limiting exemplary embodiment, as perhaps best shown in FIG. 4, a plurality of candies 50 are removably disposed within the rhombus-shaped members 13-13*c* and the pyramid-shaped members 14-14*c*.

Figure 7:
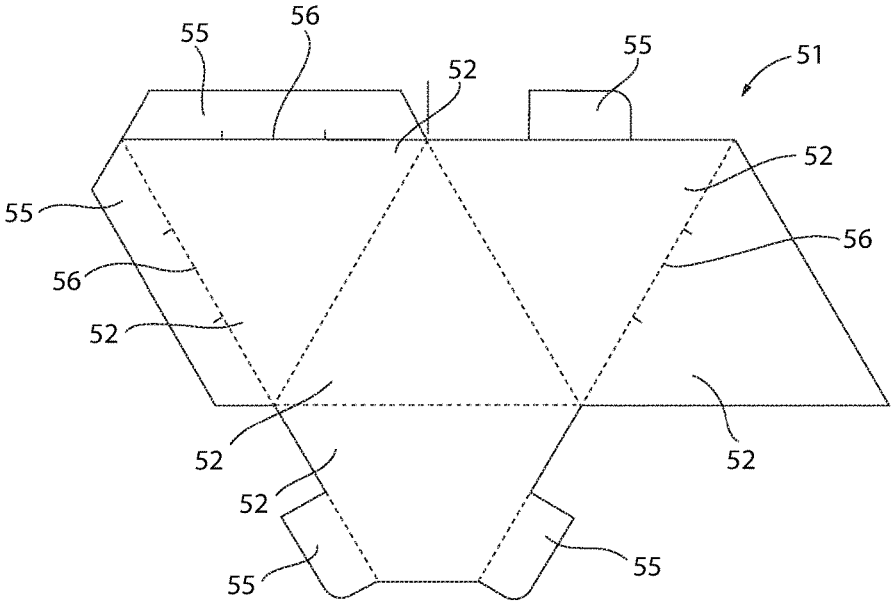
FIG. 7 is a top plan view of a two-dimensional unfolded third body of a pyramid-shaped auxiliary member, in accordance with a non-limiting exemplary embodiment of the present disclosure.
Figure 18:
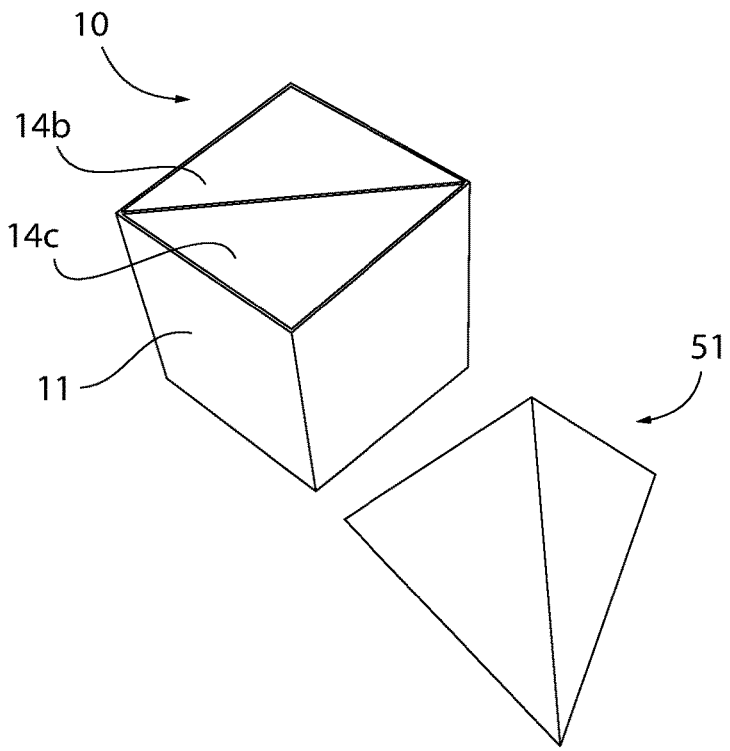
FIG. 18 is a top plan view of the pyramid-shaped auxiliary member at a three-dimensional folded orientation situated exterior of the cube-shaped box, in accordance with another non-limiting exemplary embodiment of the present disclosure.

In a non-limiting exemplary embodiment, as perhaps best shown in FIGS. 7 and 18, a pyramid-shaped auxiliary member 51 is disposed exterior of the box 11. Such a pyramid-shaped auxiliary member 51 has a plurality of coextensively shaped sides 52 dimensioned larger than the cavity 12 of the cube-shaped box 11. Similar to the rhombus-shaped members 13-13*c* and pyramid-shaped members 14-14*c*, the pyramid-shaped auxiliary member 51 has tabs 55 of which some fit into corresponding slots 56 to form the three-dimensional shape shown in FIG. 18.

In a non-limiting exemplary embodiment, each of the rhombus-shaped members 13-13*c* are coextensively shaped.

In a non-limiting exemplary embodiment, each of the pyramid-shaped members 14-14*c* are coextensively shaped.

The present disclosure further includes a method of utilizing a puzzle 10 including the steps of: providing a cube-shaped box 11 having a cavity 12 therein; providing and detachably engaging a plurality of rhombus-shaped members 13-13*c* to each other; providing and detachably engaging a plurality of pyramid-shaped members 14-14*c* to the rhombus-shaped members 13-13*c*; intercalating the rhombus-shaped members 13-13*c* between the pyramid-shaped members 14-14*c*; situating at least two of the pyramid-shaped members 14-14*c* at a top-most region of the cavity 12 of the cube-shaped box 11; and, the rhombus-shaped members 13-13*c* and the pyramid-shaped members

14-14*c* collectively creating a cube-shaped arrangement 15 removably fitted inside the cavity 12 of the cube-shaped box 11.

FIGS. 11-17 show a step-by-step process of positioning the rhombus-shaped members 13-13*c* and pyramid-shaped members 14-14*c* inside the cavity 12 of the cube-shaped box 11 to form the cube-shaped arrangement 15.

FIG. 18 is a top plan view of the pyramid-shaped auxiliary member 51 disposed at a three-dimensional folded orientation situated exterior of the cube-shaped box 11, in accordance with another non-limiting exemplary embodiment of the present disclosure.

Referring to FIGS. 1-18 in general, in a non-limiting exemplary embodiment(s), a puzzle 10, configured as a package, available in different colors including, black, silver, and gold. Whether containing chocolates, candies 50, or nuts, or simply produced as a puzzle 10 for entertainment, the configured and erected puzzle 10 draws attention and a crowd. Even the way in which several units can be uniquely displayed draws attention.

In a non-limiting exemplary embodiment, the rhombus-shaped members 13-13*c* and pyramid-shaped members 14-14*c* are arrangement in a unique manner that creates the cube-shaped arrangement 15, and it takes a little work to figure it out! It looks easy, but it is actually a challenge. Novices will try again and try again as it grabs at their curiosity. The rhombus-shaped members 13-13*c* can be stacked in between the pyramid-shaped members 14-14*c* and packaged in an attractive gift box 11. The puzzle 10 packaging preferably includes a company's logo and the name of the snack or treat within.

In a non-limiting exemplary embodiment, rhombus-shaped members 13-13*c* and pyramid-shaped members 14-14*c* are configured in a special manner to create a cube-shaped arrangement 15, which fits inside cube-shaped box 11. Truly a conversational piece and novelty item, children and adults alike would enjoy this packaging and its contents. With only one way to solve the puzzle 10 and piece together the cube-shaped arrangement 15, the puzzle 10 not only satisfies one's sweet tooth, but also provides entertainment within a fun challenge.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A puzzle comprising:

a cube-shaped box having a cavity therein;

a plurality of rhombus-shaped members detachably engaged to each other; and a plurality of pyramid-shaped members detachably engaged to said rhombus-shaped members;

wherein said rhombus-shaped members are intercalated between said pyramid-shaped members thereby collectively having a cube-shaped arrangement removably fitted inside said cavity of said cube-shaped box;

wherein said cube-shaped box is opaque such that a line of sight is blocked from an exterior of said cavity to an interior of said cavity;

wherein said pyramid-shaped members includes a first pyramid-shaped member and a second pyramid-shaped member covering a major surface area of a closed bottom side of said cube-shaped box;

wherein said pyramid-shaped members further include a third pyramid-shaped member and a fourth pyramid-shaped member covering a major surface area of an open top side of said cube-shaped box;

wherein a quantity of said pyramid-shaped members equals only four;

wherein a quantity of said rhombus-shaped members equals only four.

2. The puzzle of claim 1, wherein each said rhombus-shaped members comprises:

a single and unitary first body having a first two-dimensional initial shape and a first three-dimensional final shape; wherein said single and unitary first body further has a plurality of first lines of weakness, a plurality of first faces situated contiguously with said first lines of weakness, respectively, a plurality of first slots formed along selected ones of said first lines of weakness, and a plurality of first tabs adjustably attached to selected ones of said first faces, respectively;

wherein selected ones of said first tabs are removably inserted into selected ones of said first slots, respectively;

wherein said single and unitary first body is at an unfolded first configuration when disposed at said first two-dimensional initial shape;

wherein said single and unitary first body is at a folded first configuration when disposed at said first three-dimensional final shape.

3. The puzzle of claim 2, wherein each said pyramid-shaped members comprises:

a single and unitary second body having a second two-dimensional initial shape and a second three-dimensional final shape; wherein said single and unitary second body further has a plurality of second lines of weakness, a plurality of second faces situated contiguously with said second lines of weakness, respectively, a plurality of second slots formed along selected ones of said second lines of weakness, and a plurality of second tabs adjustably attached to selected ones of said second faces, respectively;

wherein selected ones of said second tabs are removably inserted into selected ones of said second slots, respectively;

wherein said single and unitary second body is at an unfolded second configuration when disposed at said second two-dimensional initial shape;

wherein said single and unitary second body is at a folded second configuration when disposed at said second three-dimensional final shape.

4. The puzzle of claim 1, further comprising: a plurality of candies removably disposed within said rhombus-shaped members and said pyramid-shaped members.

5. The puzzle of claim 1, further comprising: a pyramid-shaped auxiliary member disposed exterior of said box, said pyramid-shaped auxiliary member having a plurality of coextensively shaped sides dimensioned larger than said cavity of said cube-shaped box.

6. The puzzle of claim 1, wherein each of said rhombus-shaped members are coextensively shaped.

7. The puzzle of claim 1, wherein each of said pyramid-shaped members are coextensively shaped.

* * * * *